United States Patent [19]

Decho et al.

[11] Patent Number: 4,924,213

[45] Date of Patent: May 8, 1990

[54] MULTIPLE TERMINAL BLOCK INDICATOR LIGHT COMBINATION

[75] Inventors: David R. Decho, Carol Stream; William H. Jones, Villa Park, both of Ill.

[73] Assignee: Reed Devices, Inc., Carol Stream, Ill.

[21] Appl. No.: 327,744

[22] Filed: Mar. 23, 1989

[51] Int. Cl.[5] ..... G08B 21/00

[52] U.S. Cl. ..... 340/653; 340/656; 340/639; 340/642; 439/488; 439/709; 361/400; 361/426

[58] Field of Search ..... 361/400, 426; 439/488, 439/490, 491, 709, 715, 716; 340/653, 654, 656, 635, 642, 639

[56] References Cited

U.S. PATENT DOCUMENTS

| | | | |
|---|---|---|---|
| 2,923,913 | 2/1960 | Kulka | 439/491 |
| 2,981,922 | 4/1961 | Van Valkenburg | 439/717 |
| 2,981,923 | 4/1961 | Ustin | 439/491 |
| 3,202,977 | 8/1965 | Sims | 340/656 |
| 3,207,956 | 9/1965 | Rothweiler | 340/642 |
| 3,275,972 | 9/1966 | Eisert | 439/491 |
| 3,889,248 | 6/1975 | Ritter | 340/636 |

*Primary Examiner*—Joseph A. Orsino
*Assistant Examiner*—Kinfe-Michael Negash
*Attorney, Agent, or Firm*—Weingarten, Schurgin, Gagnebin & Hayes

[57] ABSTRACT

A terminal block assembly comprising terminals in combination with associated signal indicators is disclosed. The assembly includes one or more rows of terminals and, associated with each row of terminals, a row of signal indicators. The signal indicator typically is a light emitting diode. Each indicator is located in proximity to one or a few terminals, to which it may be connected electrically. Each signal indicator displays the operational status of a load module connected to a terminal on the terminal block assembly. Operational status may include fault detection, output signal, input signalling, or the like. The placement of the signal indicator immediately adjacent to its respective terminal simplifies and speeds up identification and eliminates any question of improper identification of the load modules connected to the terminal blocks.

39 Claims, 6 Drawing Sheets

MULTIPLE TERMINAL BLOCK INDICATOR LIGHT COMBINATION

FIELD OF THE INVENTION

This invention relates to electrical terminals and more particularly to electrical terminal block assemblies having multiple terminals.

BACKGROUND OF THE INVENTION

Industrial system controllers, such as programmable logic controllers, generally comprise a series of modules mounted on a printed circuit board. A typical module might, for example, control input and output functions. To enable other devices to be connected to the modules, a terminal block is mounted on the circuit board. The block generally includes a row of terminals to which wires from other devices may be removably connected. The terminal block includes pins extending from each terminal and soldered into holes in the circuit board. Connections on the circuit board electrically connect one or a few terminal pins to an individual module.

Often the operational status of each module must be individually monitored. The status of a module could, for example, be normal, abnormal, or needing service. Typically, a visual signal indicator comprising a matrix of light emitting diodes (LEDs) is employed, each LED being electrically connected to a module. The matrix of LEDs is located away from the wire connection area at the terminal block. Typical LED matrices can include 48 or more LEDs.

With this arrangement of LEDs, identifying a trouble circuit or system dysfunction, when the LED is disassociated from the actual wire termination point or terminal, is difficult. Time must be taken to trace the LED to its associated terminal. Delays in trouble shooting and remedying problems result. Such delays also increase the risk of equipment damage. Further, additional separate wiring from each LED to its terminal is needed.

SUMMARY OF THE INVENTION

The invention of the present application provides a terminal block assembly in which terminals are associated with signal indicators. The terminals are disposed in one or more rows on the terminal block and comprise, in the preferred embodiment, screw type terminals. The signal indicators are disposed in adjacent rows on the terminal block. Each signal indicator is in electrical connection with a respective terminal or group of terminals. Each signal indicator is adjacent to its associated terminal so that identification of a signal indicator with its terminal is simplified. Wiring is reduced and simplified.

DESCRIPTION OF THE DRAWINGS

The invention will be more fully understood from the following description taken in conjunction with the accompanying drawings in which.

DETAILED DESCRIPTION OF THE INVENTION

Figure 1:
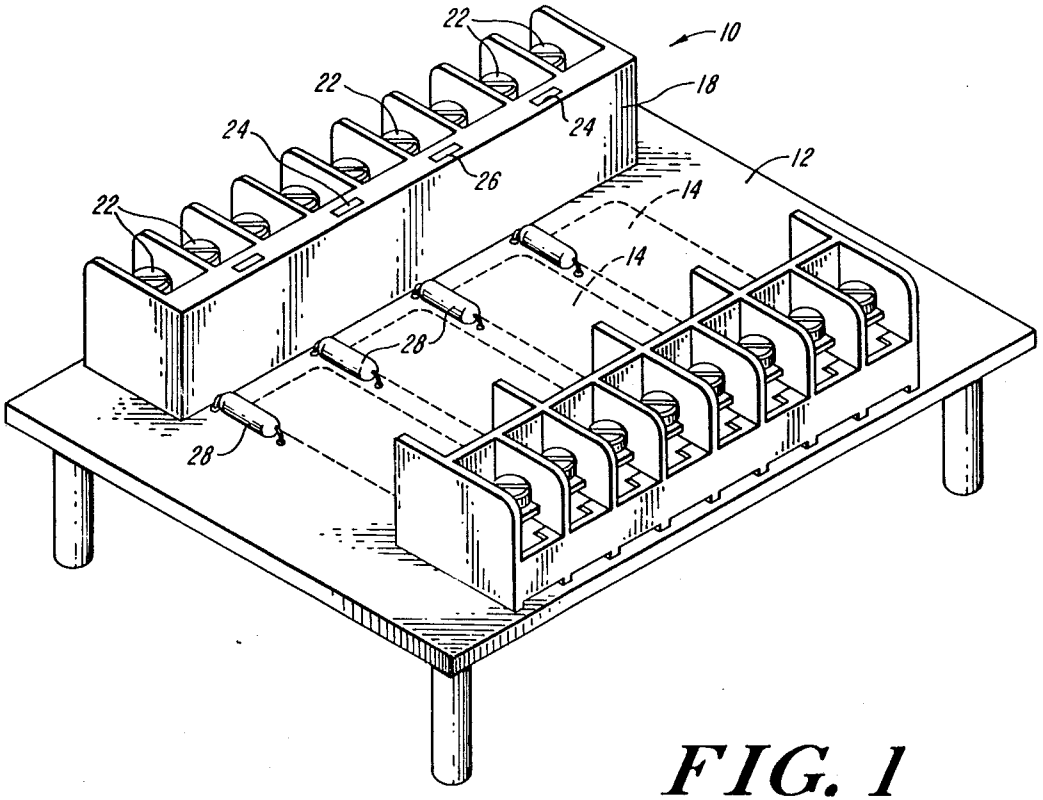
FIG. 1 is a perspective view of a first embodiment of the terminal block assembly of the present invention in use on a circuit board.

A perspective view of a first embodiment of the terminal block assembly of the present invention is shown generally at 10 in FIG. 1. The terminal block assembly is mounted on a circuit board 12. Also mounted on the circuit board are various modules, such as, for example, an input/output module, shown in dashed lines indicated by reference numeral 14. Terminal block assembly 10 comprises a housing 18 in which is disposed a row of terminals 22. The terminals are shown as screw type terminals, but other types of terminals suitable for removably connecting wires may be used. The terminals 22 are connected via printed connections on the circuit board to associated modules 14. Wires (not shown) are connected to the modules 14 via the terminals 22. Within housing 18 of the terminal block assembly are included signal indicators 24 disposed in cavities 26. Each signal indicator 24 is electrically connected to one or more terminals 22 and their associated module 14. In the embodiment shown in FIG. 1, each module 14 is associated with two terminals 22 and one signal indicator 24. It will be appreciated that each module could be associated with any number of terminals 22 and that each signal indicator 24 could be associated with any number of terminals 22 rather than with pairs of terminals as shown in FIG. 1. Resistors 28 preferably are included in the circuit for controlling the voltage or current to the signal indicator.

In the preferred embodiment, the signal indicator is illuminable, generally as an LED. Illumination indicates the operational status of the associated load module 14. The operational status may include, for example, fault detection, output signal, or input signalling. The signal indicator may be illuminated in a particular color, such as red, yellow, green, or blue, the color indicating the operational status of the associated load module 14.

Figure 2:
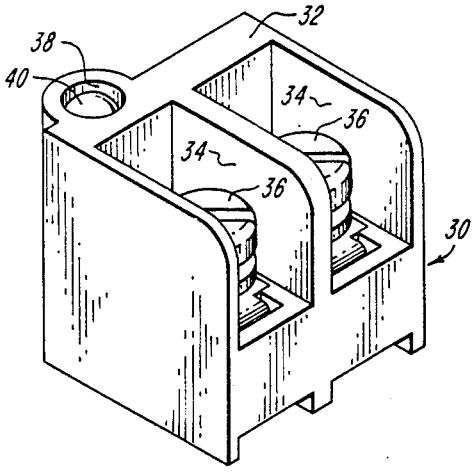
FIG. 2 is a perspective view of a second embodiment of the terminal block of the present invention.
Figure 3:
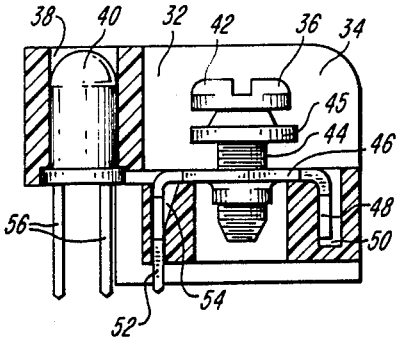
FIG. 3 is a side view of the terminal block of FIG. 2.
Figure 4:
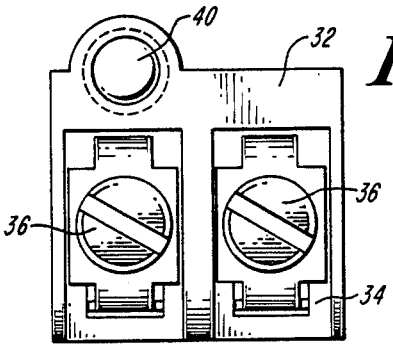
FIG. 4 is a top view of the terminal block of FIG. 2.

A second embodiment of the terminal block assembly is shown in greater detail in FIGS. 2–4. The terminal block assembly 30 comprises a housing 32 having a row of cavities 34 in which are disposed terminals 36. Although only two cavities and terminals are shown in FIG. 2, any number of cavities and terminals could be included. A further cavity 38 is disposed in the rear of the terminal housing 32 and adjacent to one of the terminals 36. Within cavity 38 is a signal indicator 40, generally an LED.

Terminal 36 is shown more fully in FIGS. 3 and 4. A wire, not shown, is connected to the terminal 36 by clamping between the screw clamp plate 45 and conductive plate 46. Plate 46 includes a first leg 48 which extends into a recess 50 in housing 32 and a second leg 52 which extends through recess 54 in housing 32. Recess 54 is open at the bottom of housing 32 so that leg 52 projects beyond housing 32 to be inserted into a hole in a circuit board (not shown) for electrical connection to a module 14.

Signal indicator 40 is mounted in cavity 38 in housing 32. The cavity may be of any suitable configuration to conform to the configuration of the signal indicator. Signal indicator 40 includes a pair of conductive leads 56 which extend below housing 38 to connect to holes in the circuit board. Signal indicator 40 may be connected to terminal 36 and module 14 via appropriate connections made on the circuit board.

Figure 5:
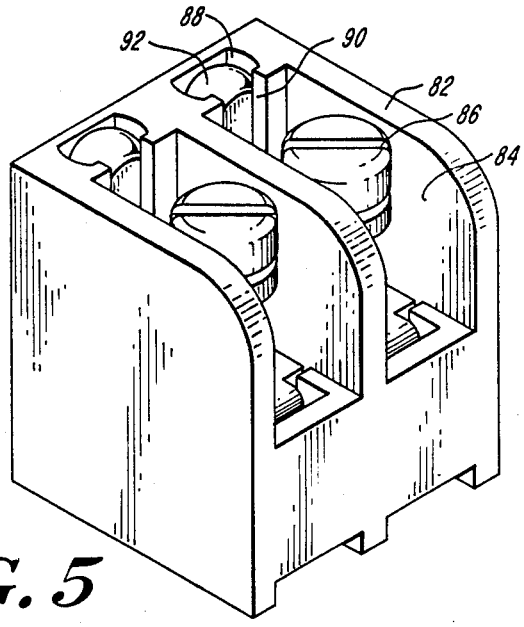
FIG. 5 is a perspective view of a third embodiment of the terminal block of the present invention.
Figure 6:
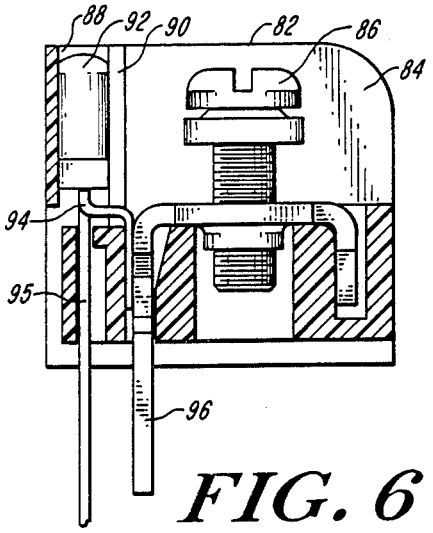
FIG. 6 is a side view of the terminal block of FIG. 5.
Figure 7:
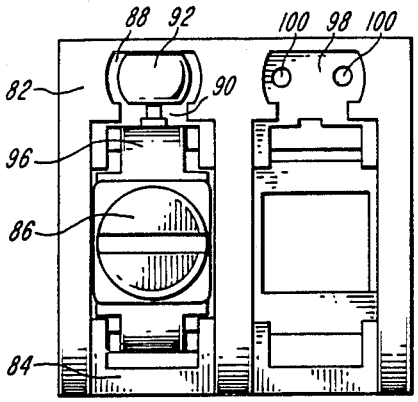
FIG. 7 is a top view of the terminal block of FIG. 5.

A third embodiment of the terminal block assembly of the present invention is shown in FIGS. 5–7. This embodiment includes a housing 82 having cavities 84 in which terminals 86 are mounted. Although screw type terminals as in the second embodiment are shown, other suitable terminals may be used. Signal indicator 92 is housed within cavity 88. Cavity 88 is of a generally rectangular shape to conform to the generally rectangular shape of indicator 92. The cavity may also include floor 98 for supporting indicator 92. Holes 100 may be provided in floor 98 for passage of the leads 94, 95.

A passage 90 connects cavity 88 with cavity 84. As best seen in FIGS. 6 and 7, one lead 94 of the pair of leads 94, 95 of the signal indicator 92 may pass through passage 90 to connect to leg 96 of terminal 86. This embodiment simplifies the necessary wiring on the circuit board by eliminating the connection from the signal indicator to the terminal, resulting in fewer soldered connections being needed.

Figure 8:
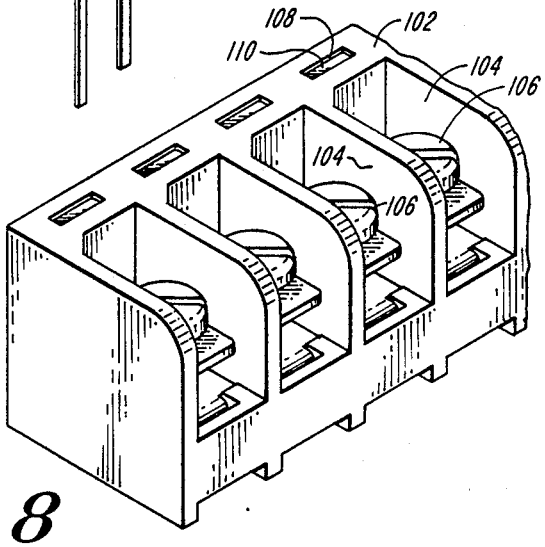
FIG. 8 is a perspective view of a fourth embodiment of the terminal block of the present invention.

FIG. 8 shows a fourth embodiment of the terminal block assembly of the present invention. The embodiment comprises a housing 102 including a row of cavities 104. Within each cavity 104 is disposed a terminal 106. A row of further cavities 108 is disposed in parallel relation to the row of cavities 104. Within each cavity 108 is housed a signal indicator 110. Each signal indicator 110 is associated with the adjacent terminal 106. Conductive leg 112 of terminal 106 extends below housing 102 to fit into a hole in a printed circuit board. Leads 114 of signal indicator 110 also extend below housing 102 to fit into appropriate holes in the circuit board. Leads 114 may be connected to leg 112 through appropriate connections made on the printed circuit board, depending upon the application circuit requirement.

Figure 9:
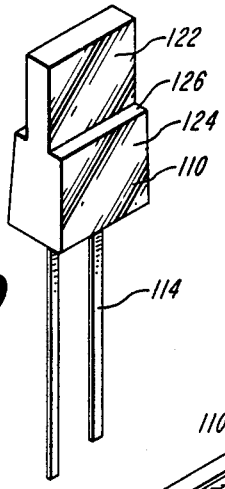
FIG. 9 is a perspective view of a light emitting diode used in conjunction with the embodiment in FIG. 8.
Figure 10:
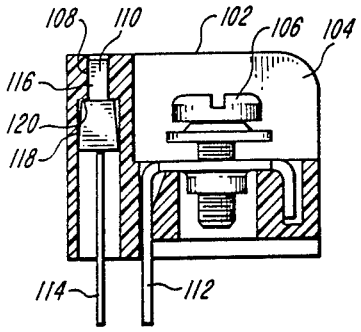
FIG. 10 is a side view of the terminal block of FIG. 8.
Figure 11:
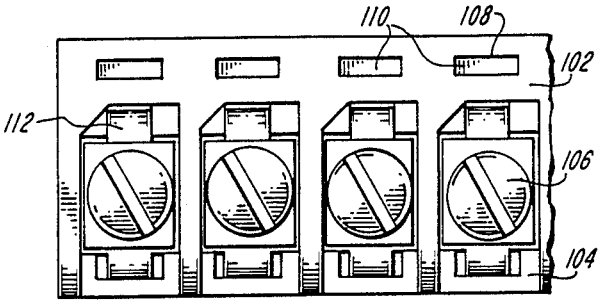
FIG. 11 is a top view of the terminal block of FIG. 8.

Signal indicator 110 may be a light emitting diode as shown in FIG. 9. This LED comprises an upper portion 122, a wider lower portion 124, and a shoulder 126. Housing 102 as shown in FIG. 10 may include within cavity 108 appropriate upper cavity 116 corresponding to upper portion 122 of the LED, lower cavity 118 corresponding to lower portion 124 of the LED, and ledge 120 corresponding to shoulder 126. It will be appreciated that the cavity in the housing of the terminal block assembly of the present invention can be formed in any manner to correspond to any shape of light emitting diode available.

Figure 12:
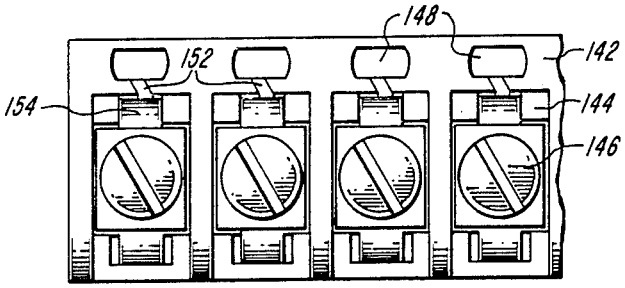
FIG. 12 is a top view of a fifth embodiment of the terminal block of the present invention.

A fifth embodiment is shown in FIG. 12. This embodiment comprises a housing 142, a row of cavities 144, and terminals 146 disposed in the row of cavities 144. A further row of cavities 148 is disposed parallel to the row of cavities 144. Each cavity 148 is shown without a signal indicator in FIG. 12, although the cavity is appropriately shaped to receive a signal indicator such as signal indicator 92 shown in FIGS. 5, 6 and 7. A further passage 152 connects cavity 148 and cavity 144. Through passage 152 a lead from the signal indicator may be passed to connect directly with leg 154 of terminal 146. The other lead from the signal indicator may connect directly with the printed circuit board (not shown).

Figure 13:
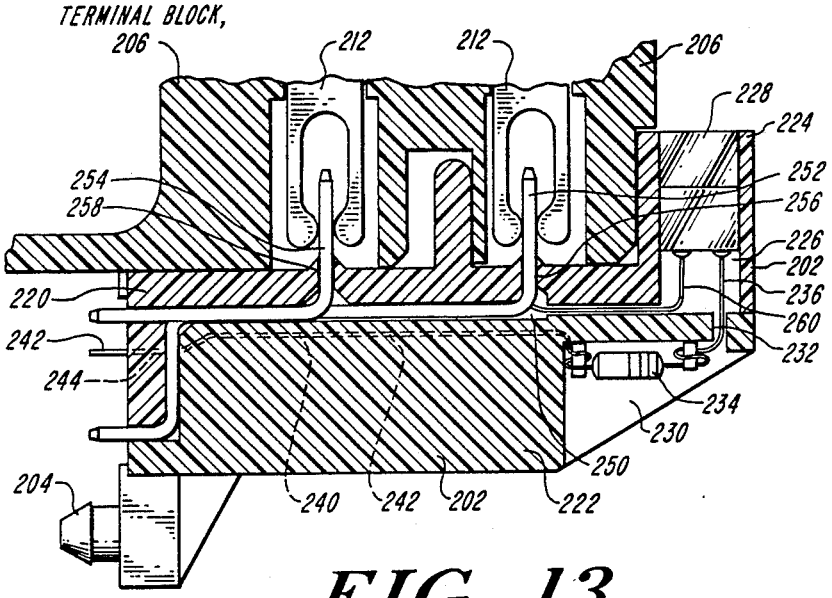
FIG. 13 is a side view of a sixth embodiment of the terminal block of the present invention.
Figure 14:
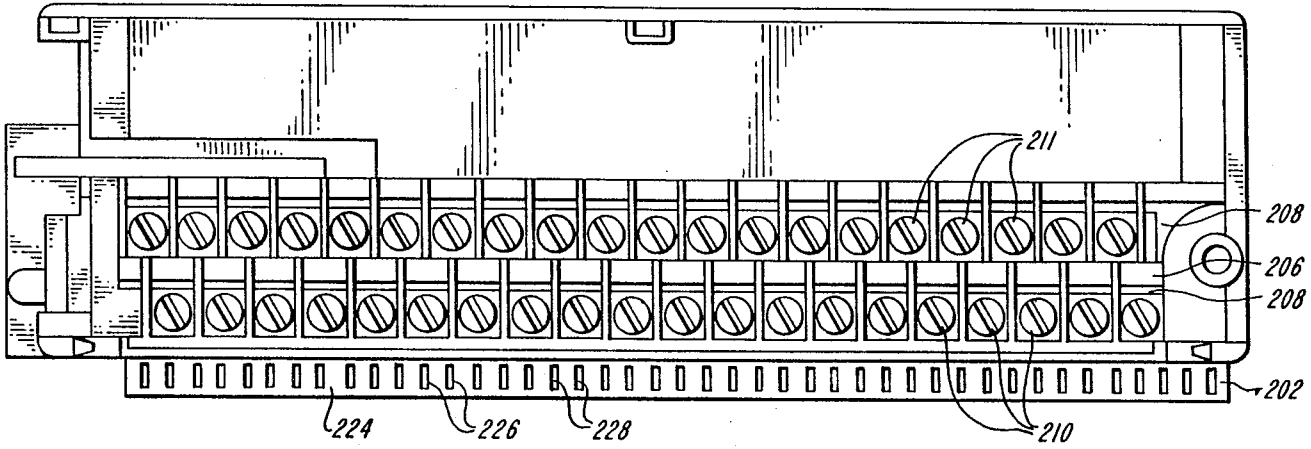
FIG. 14 is a top view of the terminal block of FIG. 13.

FIGS. 13 and 14 show a sixth embodiment of the present invention. The assembly includes header 202 adapted for mounting at pins 204 to a circuit board or other device and a terminal block 206 mountable on the header 202. The terminal block 206 may be fastened to header 202 in any suitable manner well known in the art. The terminal block comprises two or more rows of terminals shown best in FIG. 14. The embodiment shown comprises a first row of terminals 210 and a second row of terminals 211. The terminals 210 of the first row are offset with respect to the terminals 211 of the second row. Each terminal 210, 211 has depending therefrom a conductive two-pronged element 212, known as a tuning fork, best shown in FIG. 13. The prongs of the element 212 are resilient and adapted to receive a conductive lead, functioning thereby as a socket.

Header 202 includes an upper portion 220 and a lower portion 222. Upper and lower portions may be fastened together in any manner known in the art. Upper portion 220 includes upstanding member 224. Upstanding member 224 extends the length of header 202 for at least as long as the length of the rows of terminals 210, 211 on the terminal block 206, as best shown in FIG. 14. Upstanding member 224 includes a row of cavities 226. A signal indicator 228 is disposed within each cavity 226. Terminal block 206 is joined with header 202 such that upstanding member 224 extends parallel to the rows of terminals 210, 211 on the terminal block 206. In this manner, as best seen in FIG. 14, each signal indicator 228 is associated with a respective terminal 210 or 211. Since the rows of terminals are offset with respect to adjacent rows, alternating signal indicators 228 on the header 202 are associated with terminals 210 on the first row. Remaining signal indicators 228 are associated with terminals 211 on the second row. It will be appreciated that if the terminal block 206 contains three rows of terminals, every third signal indicator on the header would be associated with a terminal on the same row. A similar manner of associating signal indicators with terminals may be used for any desired number of rows of terminals.

The header 202 includes a resistor cavity 230 located beneath the signal indicator cavity 226. A passage 232 connects signal indicator cavity 226 with resistor cavity 230. A resistor 234 may be mounted within resistor cavity 230 and connected via lead 236 to signal indicator 228. Lower portion 222 of header 202 includes a further passage 240 shown in dotted lines in FIG. 13, in which the lead 242 extending from the opposite end of resistor 234 is disposed. Lead 242 passes through a further passage 244 in upper portion 220 of header 202 exiting therefrom at the rear of header 202.

The area between upper portion 220 and lower portion 222 of header 202 forms passages 250. Within a passage 250 are disposed first contact leads 252 and second contact leads 254. First contact leads 252 extend through passages 256 within upper portion 220. Second contact leads 254 extend through passages 258 in upper portion 220. First contact lead 252 extends into socket 212 associated with the first row of terminals 210 within the terminal block 206 when terminal block 206 and header 202 are joined. Similarly, second contact lead 254 extends into socket 212 within the terminal block 206. Contact leads 252 and 254 extend from the rear of header 202. Contact leads 252 and 254 may be inserted into holes in an associated circuit board.

Signal indicator 228 includes a second lead 260 which also extends through passage 250 between upper portion 220 and lower portion 222. Lead 260 comes into electrical contact with either first contact lead 252 or second contact lead 254. In this manner, signal indicator 228 is connected to an associated terminal 210 or 211.

Figure 15:
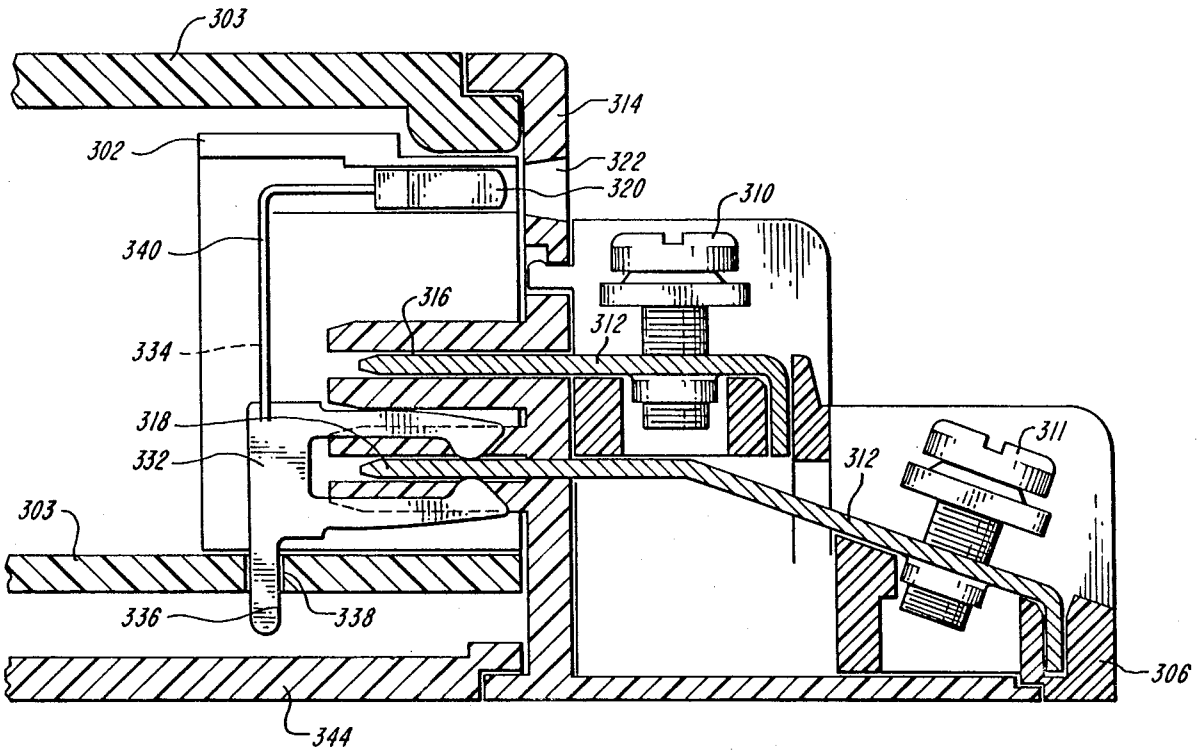
FIG. 15 is a side view of a seventh embodiment of the terminal block of the present invention.

A seventh embodiment is shown in FIG. 15. This embodiment comprises header 302 and terminal block 306. Header 302 is mounted within housing 303. Two rows of terminals 310, 311 are carried on the terminal block 306, the first or upper row of terminals 310 being offset both horizontally and vertically from the second or lower row. The terminals 311 of the second row shown in FIG. 15 are further inclined at an angle to the first row of terminals 310. The second row may be inclined at any suitable angle or does not have to be inclined at all. Associated with each terminal 310 or 311 is a conductive plate 312.

Terminal block 306 includes wall 314 through which are passages 316 and 318. Passages 316 are associated with the upper row of terminals 310 and passages 318 are associated with the lower row of terminals 311. Conductive members or plates 312 extend through passages 316, 318.

Header 302 and housing 303 may be fastened in any suitable manner to terminal block 306. Header 302 houses signal indicators 320. Wall 314 of terminal block 306 further includes opening 322 When header 302 is fastened to terminal block 306, signal indicator 320 is adjacent to opening 322. In this manner, signal indicator 320 may be readily viewed.

Header 302 further includes two rows of electrical contacts 332, 334 in the form of two-pronged tuning forks. Lower row of tuning forks 332 is adapted to mate with plates 312 associated with terminals 311 on the lower row of terminals. Upper row of tuning forks 334 is adapted to mate with plates 312 associated with the upper row of terminals 310. The tuning forks are carried within cavities in header 302 and include leads 336 which extend through passages 338 within header housing 303. Leads 336 may be connected to other devices with wires (not shown).

Signal indicator 320 includes lead 340 which may be bent to contact tuning fork 332 or 334. In this manner, individual signal indicators 320 are electrically contacted with respective terminals 310, 311. When header 302 is joined with terminal block 306 and plates 312 are mated with tuning forks 332, 334, back cover 344 may be placed to cover leads 336 extending from header 302.

The invention is not to be limited by what has been particularly shown and described, except as indicated in the appended claims.

We claim:

1. An electrical terminal block assembly for use in combination with a circuit board, comprising:

a terminal block housing adapted for mounting onto the circuit board;

a plurality of terminals disposed in said terminal block housing, each of said plurality of terminals having at least one conductive member extending below said housing for coupling to the circuit board;

signalling means for indicating operational status disposed on said terminal block housing in proximate alignment and association with said plurality of terminals, said signalling means having at least one conductive lead extending below said housing for coupling to the circuit board.

2. The electrical terminal block assembly of claim 1 wherein the plurality of signalling means comprise light emitting diodes.

3. The electrical terminal block assembly of claim 1 wherein the plurality of terminals are further disposed in a row.

4. The electrical terminal block assembly of claim 1 wherein the plurality of terminals are further disposed in at least two rows.

5. The electrical terminal block assembly of claim 4 wherein the at least two rows of terminals are spaced apart vertically on the terminal block.

6. The electrical terminal block assembly of claim 4 wherein the terminals of each row are spaced in staggered relation to the terminals of an adjacent row.

7. The electrical terminal block assembly of claim 1 wherein each signalling means is disposed within respective ones of a plurality of cavities in the terminal block housing.

8. The electrical terminal block assembly of claim 7 wherein the terminal block housing further includes a passage extending from each of the cavities; and a conducting means disposed in each passage electrically connects each signalling means and its associated terminal.

9. The electrical terminal block assembly of claim 1 wherein said signalling means is in electrical connection with said plurality of terminals with which it is in association.

10. The electrical terminal block assembly of claim 1 wherein the terminal block housing further includes a plurality of passages therethrough, each passage associated with each signalling means; and each signalling means further includes a conducting means disposed within its associated passage, the conducting means electrically connecting the signalling means and its associated terminal.

11. The electrical terminal block assembly of claim 1 wherein said plurality of terminals comprises at least two terminals and further wherein said signalling means comprises at least one signal indicator in association with said plurality of terminals.

12. The electrical terminal block assembly of claim 1 wherein said signalling means comprises a plurality of signal indicators, each of said plurality of terminals being associated with one signal indicator of said signalling means.

13. The electrical terminal block assembly of claim 1 wherein the signalling means includes means for indicating an operational status of a device connected to the electrical terminal block assembly.

14. The electrical terminal block assembly of claim 1 wherein the signalling means includes means for indicating a fault mode of a device connected to the electrical terminal block assembly.

15. The electrical terminal block assembly of claim 1 wherein the signalling means is illuminable in a color, the color indicating an operational status of a device connected to the electrical terminal block assembly.

16. The electrical terminal block assembly of claim 15 wherein the color is red, yellow, green, or blue.

17. The electrical terminal block assembly of claim 1 wherein the signalling means is illuminable in a color, the color indicating a fault mode of a device connected to the electrical terminal block assembly.

18. The electrical terminal block assembly of claim 17 wherein the color is red, yellow, green, or blue.

19. An electrical terminal block assembly comprising:

a header including a plurality of passages;

a terminal block matable with said header;

a plurality of terminals disposed in an array on said terminal block housing;

a plurality of first contacting means disposed on said terminal block, each first contacting means located proximate to and electrically connected with a respective terminal;

a plurality of signalling means disposed on said header, each signalling means associated with a respective terminal;

a plurality of second contacting means disposed on said header wherein said plurality of passages extend through said header from each signalling means to an opposite face of said header and each second contacting means is disposed within a respective passage, each second contacting means located proximate to and electrically connected with a respective signalling means; and each first contacting means matable with a respective second contacting means to maintain electrical contact and each signalling means in proximate alignment with its associated terminal when said terminal block housing is mated with said header.

20. The electrical terminal block assembly of claim 19 wherein each first contacting means comprises a socket and each second contacting means comprises a pin matable with the socket.

21. The electrical terminal block assembly of claim 19 wherein the plurality of terminals are disposed in at least two rows.

22. The electrical terminal block assembly of claim 21 wherein the terminals in each row are disposed in staggered relation to the terminals in an adjacent row; and the first contacting means are disposed in as many rows as are the terminals, each first contacting means being in direct contact with its associated terminal.

23. The electrical terminal block assembly of claim 22 wherein each first contacting means comprises a socket and each second contacting means comprises a pin matable with the socket.

24. The electrical terminal block assembly of claim 19 wherein each first contacting means comprises a pin and each second contacting means comprises a socket matable with the pin.

25. The electrical terminal block assembly of claim 19 wherein the terminal block further includes a plurality of cavities, each cavity positioned below a respective terminal, each first contacting means disposed within a respective cavity.

26. The electrical terminal block assembly of claim 19 wherein the header further includes a plurality of apertures connecting with each passage and extending in a substantially normal direction from each passage at a location intermediate the signalling means and the opposite face of the header; and the second contacting means further includes conducting means disposed within and extending beyond the apertures to mate with the first contacting means on the terminal block when the terminal block is mated with the header.

27. The terminal block assembly of claim 26 wherein each conducting means of each second contacting means is a pin and each first contacting means is a socket matable with the pin.

28. The electrical terminal block assembly of claim 19 wherein the terminal block further includes a base and a wall upstanding from the base in a normal direction, and the plurality of terminals are mounted on the base; and the wall includes a plurality of first apertures, and each signalling means is disposed adjacent a respective first aperture when the terminal block is mated with the header.

29. The electrical terminal block assembly of claim 28 wherein the wall of the terminal block further includes a plurality of second apertures, each first contacting means disposed within a respective second aperture.

30. The electrical terminal block assembly of claim 29 wherein each second contacting means is a socket and each first contacting means is a pin matable with the socket.

31. The electrical terminal block assembly of claim 28 wherein the plurality of terminals are disposed in an upper row and a lower row, the upper row being spaced a greater distance from the base of the terminal block than the lower row.

32. The electrical terminal block assembly of claim 31 wherein the terminals of the lower row are mounted on the terminal block at an angle with respect to the terminals of the upper row.

33. The electrical terminal block assembly of claim 19 further including a housing, the header mounted within the housing, the housing having an opening therethrough;

the header further including a plurality of cavities therein, each signalling means retained within a respective cavity; and each second contacting means comprises a socket mounted within the header and a conductive portion extending through the opening in the header.

34. The electrical terminal block assembly of claim 19 wherein each signalling means includes means for indicating an operational status of a device connected to the electrical terminal block assembly.

35. The electrical terminal block assembly of claim 19 wherein each signalling means includes means for indicating a fault mode of a device connected to the electrical terminal block assembly.

36. The electrical terminal block assembly of claim 19 wherein each signalling means is illuminable in a color, the color indicating an operational status of a device connected to the electrical terminal block assembly.

37. The electrical terminal block assembly of claim 36 wherein the color is red, yellow, green, or blue.

38. The electrical terminal block assembly of claim 19 wherein each signalling means is illuminable in a color, the color indicating a fault mode of a device connected to the electrical terminal block assembly.

39. The electrical terminal block assembly of claim 38 wherein the color is red, yellow, green, or blue.

* * * * *